US010619961B2

(12) United States Patent
Milde, Jr.

(10) Patent No.: US 10,619,961 B2
(45) Date of Patent: Apr. 14, 2020

(54) APPARATUS AND METHOD FOR ASSISTING LAW ENFORCEMENT IN MANAGING CRISIS SITUATIONS

(71) Applicant: Karl F. Milde, Jr., Somers, NY (US)

(72) Inventor: Karl F. Milde, Jr., Somers, NY (US)

( * ) Notice: Subject to any disclaimer, the term of this patent is extended or adjusted under 35 U.S.C. 154(b) by 0 days.

(21) Appl. No.: 16/257,408

(22) Filed: Jan. 25, 2019

(65) Prior Publication Data

US 2019/0195586 A1 Jun. 27, 2019

Related U.S. Application Data

(60) Continuation-in-part of application No. 15/728,741, filed on Oct. 10, 2017, now Pat. No. 10,222,158, which is a continuation-in-part of application No. 15/432,140, filed on Feb. 14, 2017, now Pat. No. 9,803,942, which is a continuation-in-part of application No. 15/063,665, filed on Mar. 8, 2016, now Pat. No. 9,644,912, which is a division of application No. 14/513,344, filed on Oct. 14, 2014, now Pat. No. 9,316,454, which is a continuation-in-part of application No. 14/562,854, filed on Dec. 8, 2014, now Pat. No. 9,303,935, which is a continuation of application No. 14/140,658, filed on Dec. 26, 2013, now Pat. No. 8,931,195.

(60) Provisional application No. 62/562,652, filed on Sep. 25, 2017, provisional application No. 61/841,559, filed on Jul. 1, 2013.

(51) Int. Cl.
*F41A 17/06* (2006.01)
*F41C 33/02* (2006.01)

(52) U.S. Cl.
CPC ..... *F41A 17/063* (2013.01); *F41A 17/06* (2013.01); *F41A 17/066* (2013.01); *F41C 33/029* (2013.01)

(58) Field of Classification Search
CPC ..... F41A 17/063; F41A 17/066; F41A 17/46; F41A 17/06; F41A 17/08; F41C 33/029
USPC ..... 42/70.01
See application file for complete search history.

(56) References Cited

U.S. PATENT DOCUMENTS

| | | | | |
|---|---|---|---|---|
| 9,644,911 | B1 * | 5/2017 | Mclean, III | F41A 17/063 |
| 2008/0204231 | A1 * | 8/2008 | Hietanen | F41A 17/063 340/568.1 |
| 2015/0184963 | A1 * | 7/2015 | Milde, Jr. | F41A 17/066 42/70.06 |
| 2017/0176123 | A1 * | 6/2017 | Milde, Jr. | F41A 17/066 |

* cited by examiner

*Primary Examiner* — Stephen Johnson
(74) *Attorney, Agent, or Firm* — Karl F. Milde, Jr.

(57) ABSTRACT

Evidence collecting and recording apparatus for collecting and preserving evidence of an event relating to the use of a gun, for example when it is removed from its holster and aimed at a person who might be a threat. The apparatus comprises an electronic camera and a short-range wireless transmitter, configured to be disposed on the gun, for creating and transmitting a video stream, and an electronic relay device, such as a smartphone, for wirelessly re-transmitting the video stream to a remote central station for display on a video screen. The electronic relay device and/or the central station includes a logic device for processing the video stream to determine the identity of any person appearing in the video images. Advantageously, facial recognition is used to identify the person or persons in the video images.

12 Claims, 3 Drawing Sheets

APPARATUS AND METHOD FOR ASSISTING LAW ENFORCEMENT IN MANAGING CRISIS SITUATIONS

CROSS-REFERENCE TO RELATED PATENTS AND PATENT APPLICATIONS

This application is a continuation-in-part of the U.S. patent application Ser. No. 15/728,741 filed Oct. 10, 2017 (now U.S. Pat. No. 10,222,158), which was a continuation-in-part of the U.S. patent application Ser. No. 15/432,140 filed Feb. 14, 2017 (now U.S. Pat. No. 9,803,942) which, in turn, was a continuation-in-part of U.S. patent application Ser. No. 15/063,665 filed Mar. 8, 2016 (now U.S. Pat. No. 9,644,912), which application was a division of U.S. patent application Ser. No. 14/513,344, filed Oct. 14, 2014 (now U.S. Pat. No. 9,316,454), which was a continuation-in-part of U.S. patent application Ser. No. 14/562,854, filed Dec. 8, 2014 (now U.S. Pat. No. 9,303,935), which was a continuation of U.S. patent application Ser. No. 14/140,658 filed Dec. 26, 2013 (now U.S. Pat. No. 8,931,195), which was a non-provisional of the Provisional Application No. 61/841,559 filed Jul. 1, 2013. U.S. Pat. No. 15,728,741, filed on Oct. 10, 2017, has a Provisional Application No. 62/562,652, filed on Sep. 25, 2017.

This application also claims priority from U.S. Provisional Application No. 62/562,652 filed Sep. 25, 2017.

The subject matter of this application is also related to that of U.S. Pat. Nos. 9,140,509 and 9,217,616.

The disclosures (the specification, claims and drawings) of all of the patents and patent applications referred to above are incorporated herein by reference and are to be considered and treated as a part of the original disclosure of the present application as if they were fully set forth.

BACKGROUND OF THE INVENTION

The present invention relates to an apparatus and method for use by law enforcement officers and private security personnel in the field when they are called upon to engage a threat and, in doing so, they pull their handgun from its holster.

Law enforcement and security officers rarely have a need to draw their weapon from their holster. When they do, however, it is because they are facing a "crisis situation" that can pose a threat to their own, and/or to someone else's, life. Such a situation may escalate, or may already have escalated, to the point where they have a need to fire their weapon. It is important in these cases that the officer be provided with as much information as possible about the person or persons who are responsible for creating the threat; i.e., the perpetrator or perpetrators who have caused the crisis. In particular, it would be extremely helpful to know exactly who the perpetrator(s) is/are, and whether such person(s) has/have engaged in prior offenses or illegal activity.

In some cases, when the persons causing a crisis—for example, one or more persons who is/are threatening others with a gun—are near to, and not readily distinguishable from, other innocent individuals, it is important to identify the one(s) who is/are the perpetrator(s) and to determine their exact location, often within a public building.

The U.S. Pat. Nos. 9,140,509 and 9,217,616 teach an "evidence collecting and recording" system for transmitting live video to a central command station from a camera disposed on the muzzle of an officer's gun.

According to a preferred embodiment of the system disclosed in these patents, the evidence collecting apparatus on the gun comprises: (1) at least one sensor, such as a camera but also other types of sensors, for obtaining "gun-related data"; (2) a first digital logic device, coupled to the sensor or sensors, for receiving and forwarding the gun-related data; and (3) a wireless transmitter ("T") device, coupled to the first logic device, for transmitting the gun-related data received from this logic device to a relay device of some sort.

As disclosed in these patents, the evidence collecting system also includes an electronic relay device, such as a smartphone, that comprises:

(1) a wireless receiver ("R") device, for receiving the gun-related data from the T device;

(2) a wireless transmitting device for transmitting the received gun-related data to a remote central station via a wireless network; and (3) a second digital logic device, coupled, to the R device for receiving and forwarding the gun-related data to the central station.

This evidence collecting and recording system advantageously further comprises a gun holster and a sensor device for determining when the gun is removed from the holster.

Advantageously too, the electronic relay device (e.g., a smartphone) includes a data memory, coupled to the second logic device, for recording the evidence received by transmission from the data collecting apparatus prior to uploading it to the central station.

According to a particular embodiment of the system disclosed in the aforementioned patents, the second logic device is programmed to automatically initiate a call for assistance. This may occur, for example, when the gun is removed from its holster, or when a shot is fired.

The gun is advantageously provided with one or more of the following evidence collecting sensors: (i) a holster sensor for sensing that the gun is removed from a holster; (ii) a video camera arranged to view forward in the direction of aim of the gun and/or in the direction of the holder of the gun; (iii) a microphone arranged to receive sounds in the vicinity of the gun; (iv) a direction finder for determining the azimuthal direction of aim of the gun; (v) a trigger-pull sensor, or other sensor device such as the microphone or an accelerometer, for sensing that the gun has been fired; and (vi) a level sensor for determining the angle of aim of the gun with respect to the vertical.

Advantageously too, the electronic relay device (e.g., the smartphone) is provided with one or more of the following evidence-collecting devices: (i) a clock for determining the time that the gun is removed from the holster and/or the time that the gun is fired; and (ii) a GPS for determining the location of the gun when it is removed from the holster and/or when it is fired.

SUMMARY OF THE PRESENT INVENTION

A principal objective of the present invention is to provide an "evidence collecting and recording" system of the type described above, and disclosed in the aforementioned U.S. Pat. Nos. 9,140,509 and 9,217,616, which serves the needs of the law enforcement officers and security personnel in the field.

A more particular objective of the present invention is to provide an evidence collecting and recording system of the type described above which enhances the safety of law enforcement officers and security personnel when they are called upon to interdict a dangerous threat.

These objectives, as well as other objectives which will become apparent from the discussion that follows, are achieved, according to the present invention, by providing an evidence collecting and recording system which comprises (1) an electronic camera and a short-range wireless transmitter, configured to be disposed on the gun, for creating and transmitting a video stream, and (2) an electronic relay device, such as a smartphone, for wirelessly re-transmitting the video stream to a remote central station for display on a video screen. According to the invention, the central station includes a logic device for processing the video stream to determine the identity of any person or persons appearing in the video images.

In a preferred embodiment of the invention, the identity of such person(s) is/are determined using a facial recognition algorithm.

Upon making the identification, the central station transmits the identity of such person(s) to the smartphone, together with any known information about the person(s), such as prior arrests, which may be helpful to the officers in the field.

Advantageously, either Bluetooth or WiFi, or both, may be used as the short-range wireless transmission protocol to transmit the video stream from the gun camera to the electronic relay device smartphone).

Advantageously too, the electronic evidence collecting device further includes a microphone and the video stream which is forwarded to the central station includes sound. In this way, the law enforcement officer in the field can speak to the person on duty at the central station and voices at the scene of the incident can be recorded at the central station.

In a preferred embodiment, the evidence collecting and recording system includes a holster for the gun, to which the electronic camera and short-range wireless transmitter are attached, and a sensing device which senses when the gun is removed from the holster. To save battery power, the electronic camera and short-range wireless transmitter remain inactive when the gun is in the holster, and are activated only when the gun is drawn.

Whenever the gun is out of the holster, however, a live video stream is continuously transmitted to the electronic relay device (e.g., the smartphone) and relayed to the central command station for display and recording.

Alternatively, or in addition, the video images can be recorded in the relay device (e.g., the smartphone) for later viewing and/or downloading.

DETAILED DESCRIPTION OF THE PREFERRED EMBODIMENTS

Figure 1:
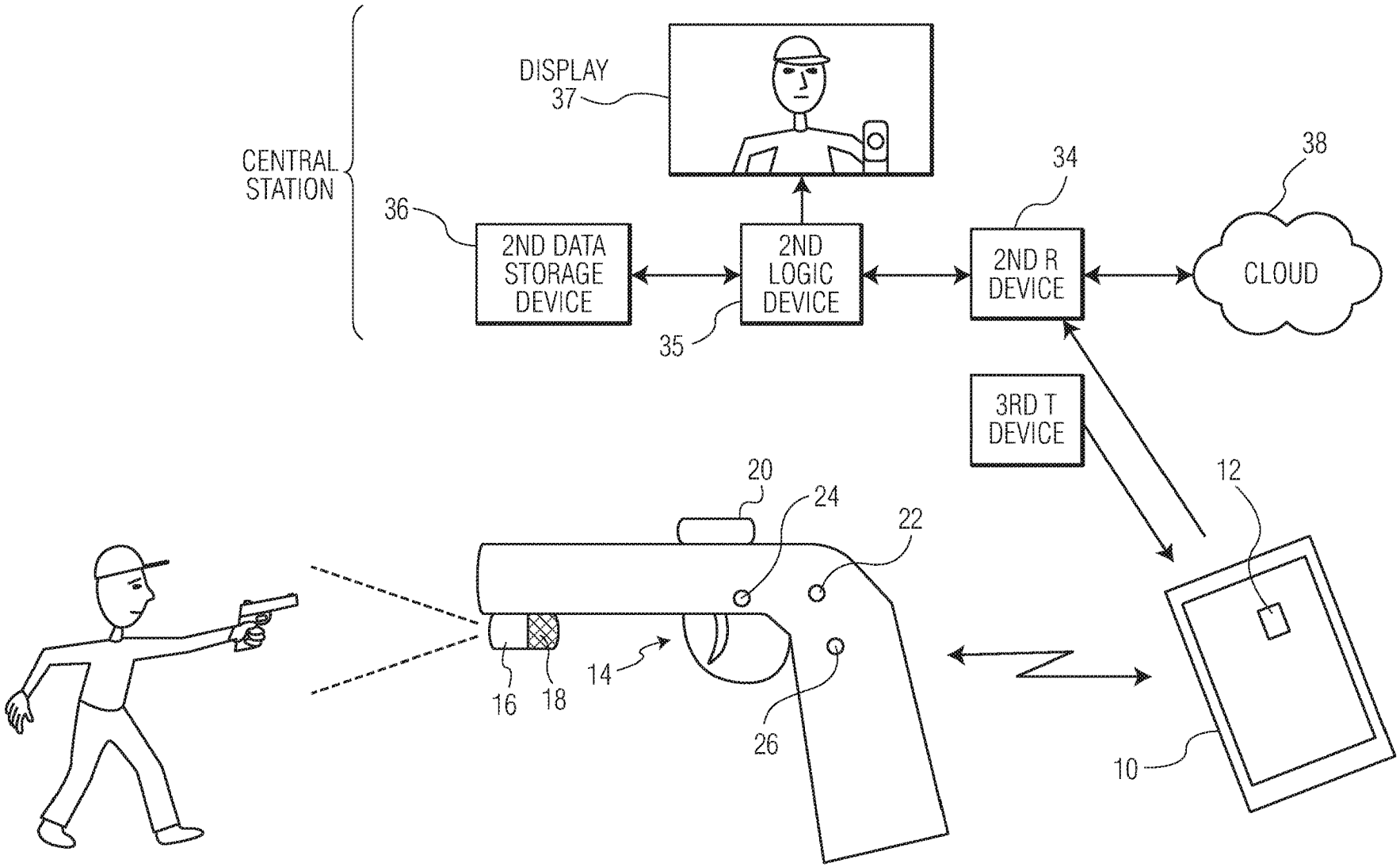
FIG. 1 is a representational diagram showing a gun that is equipped with an electronic evidence collecting device, a smartphone having an app for relaying data received from the evidence collecting device to a remote central command station, and the central station itself for receiving the data from the smartphone and storing and displaying this data.

The preferred embodiments of the present invention will now be described with reference to FIGS. 1-3 of the drawings. Identical elements in the various figures are identified with the same reference numerals.

FIG. 1 shows a battery-operated electronic relay device, in this case a smartphone 10, having an application or "app" 12 which may be selected by user or run continuously in the background, for example when the user is "on duty" as law enforcement officer. The device 10 communicates wirelessly, for example by the Bluetooth or WiFi protocol, with an evidence collecting device on a handgun 14. The evidence collecting device comprises one or more sensors 16, 18, 20, 22, 24 and 26 connected to a logic device 23 (see FIG. 3) with a (e.g. Bluetooth or WiFi) transmitter 28. WiFi may be preferred over Bluetooth because of the greater bandwidth available for transmission of information, but WiFi normally requires more battery power than does Bluetooth.

The sensors preferably include:

(1) a video camera 16 arranged and aligned in the direction of aim of the gun 14 to view the area in front of the gun;

(2) a microphone 18 arranged to receive audio from the user of the gun;

(3) a direction finder 20 arranged to detect the azimuthal direction in which the gun is aimed;

(4) a light sensor, magnetic sensor or any other type of sensor 22 for detecting when the gun has been removed from a holster;

(5) a trigger-pull sensor or any other type of sensor device 24, such as the aforementioned microphone or an accelerometer, for sensing that the gun has been fired; and (6) a level sensor 26 for determining the angle of aim of the gun with respect to the vertical.

Figure 2:
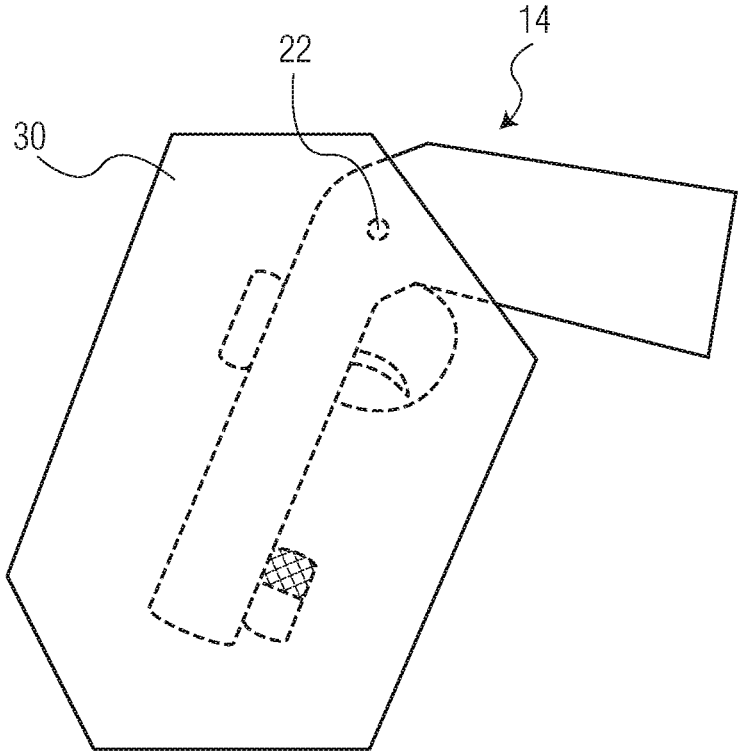
FIG. 2 is a close-up view of the gun of FIG. 1 arranged in a holster.

As shown in FIG. 2, the sensor 22 on the gun 14 senses when the gun is holstered. When removed from its holster 30, the sensor 22 detects this removal. In this event, the sensor 22 initiates the collection of gun-related data from the other sensors 16, 18 and 20, 24 and 26 and the transmission of this data to the electronic relay device (e.g. the smartphone) 10.

Referring again to FIG. 1, when the relay device (e.g., smartphone) 10 receives the gun-related data—for example, the live video stream from the gun camera 16—it relays this digital data via a wireless network (e.g., the public telephone network) to a receiver device 34 (labeled the "2nd R Device") at a remote central command station having a source of power (not shown). The central station includes a logic device 35 (labeled the "2nd Logic Device"), a mass data storage device 36 (labeled the "2nd Data Storage Device"), a display device 37, and a connection to the "Cloud" 38 that facilitates further storage and retrieval of data and provides any needed services, such as identifying the person or persons at which the gun is aimed.

According to the invention, the smartphone 10 and/or the second logic device 35 at the central station includes an algorithm for determining the identity of a person or persons captured in the video images, for example by the use of facial recognition. The identity, as well as any known data about such person(s), such as a mug shot and/or information about prior arrests, are preferably transmitted back via the wireless network by a third transmitter device (labeled '3rd T Device') to the smartphone 10 for information of, and assistance to, the law enforcement officer in the field.

By way of example but not limitation, the cloud 38 can provide information regarding known criminals, for comparison with the perpetrators seen by the gun-camera during a crisis situation, and can provide a facial recognition capability or other algorithms for identifying person(s) in the video images.

Figure 3:
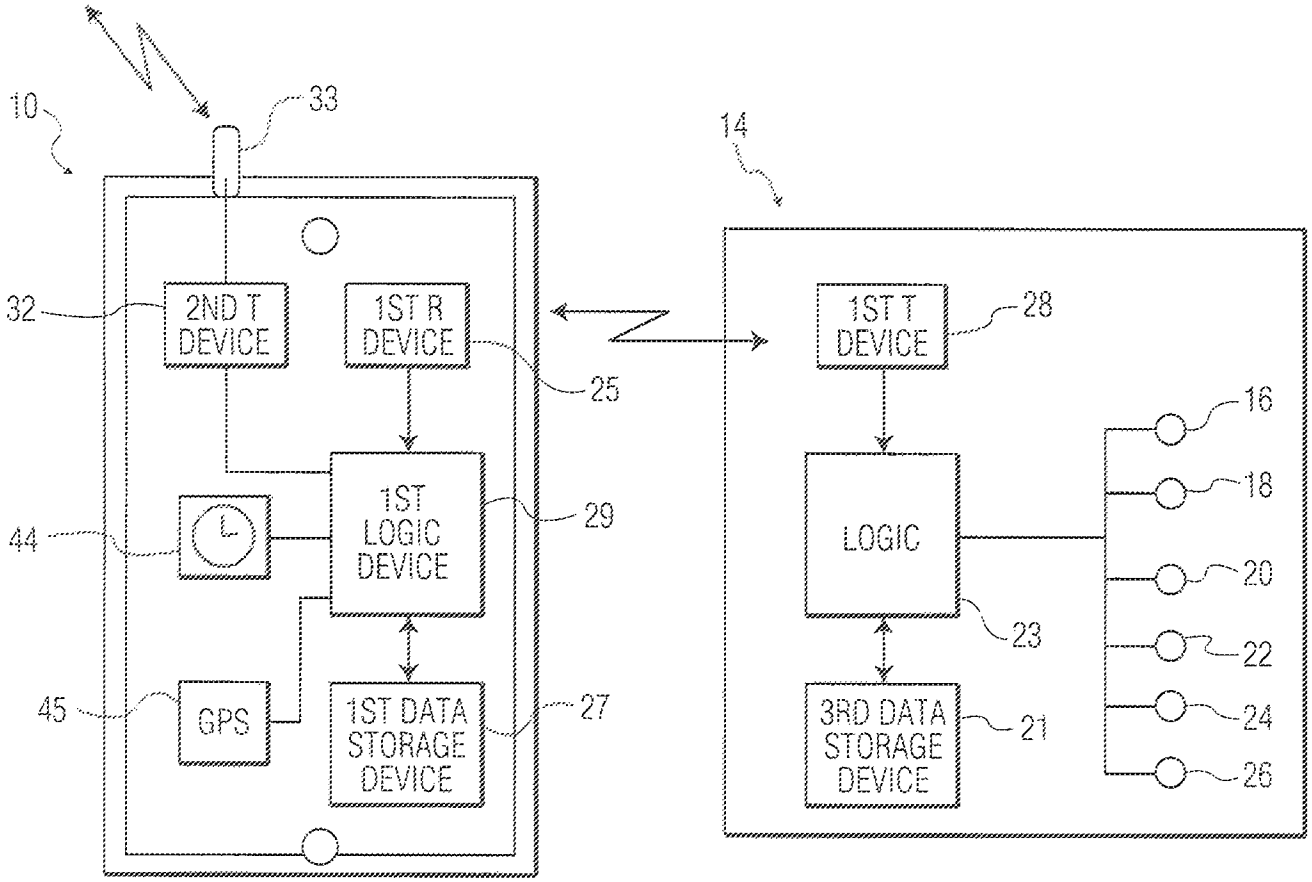
FIG. 3 is a block diagram showing a preferred embodiment of the evidence collecting and recording apparatus.

FIG. 3 is a block diagram showing the evidence collecting device on the gun 14 and the electronic relay device 10 to which it transmits. The evidence collecting device 14 and the relay device 10 are each provided, respectively, with a first power source (not shown) and a second power source (not shown), such as rechargeable batteries. The evidence collecting device 14 includes the aforementioned sensors 16, 18, 20, 22, 24 and 26, all connected to a logic device 23 which is activated upon removal of the gun from its holster and forwards the sensed, gun-related data via a first transmitter device 28 (for example, Bluetooth or Wifi and labeled '1st T Device') to the relay device 10. The gun-related data may be stored in a data memory 21 if desired or required.

The electronic relay device 10 receives the gun-related data via a first receiver device 25 (for example, Bluetooth or Wifi and labeled '1st R Devise') and a logic device 29 (labeled '1st Logic Device'), and temporarily records this data in a memory 27 (labeled '1st Data Storage Device'). Thereafter, the device 10 uploads the gun-related data via a second transmitter device 32 (e.g. the cell-phone transmitter labeled '$2^{nd}$ T Device') and antenna 33 to the central station (see FIG. 1). The video information is preferably transmitted a lower frame rate than the standard frame rate for video, and/or with a lower resolution than the standard resolution, in order to rapidly upload the video images to the central station (e.g., a police station) for immediate viewing and responsive action.

Immediately upon receipt of a signal that the user's gun has been removed from its holster, the first logic device 29 can automatically cause the relay device 10 to make a cell-phone call to the user's partner and/or to the central station to request assistance, and backup. The relay device 10 (e.g., smartphone) can also automatically commence taking pictures or shooting a video, and can start recording sound from its own camera and microphone, respectively. If the phone is located on the shoulder of the law enforcement officer, for example, or if it is held in the officer's hand, it can collect important evidence at this critical time.

When so activated, and when recording the gun-related data transmitted from the gun in its first data storage device 27, the relay device 10 can also record the exact time and location of each significant event, such as the removal of the gun from its holster and/or the firing of the gun, using its internal clock 44 and GPS locator 45.

There has thus been shown and described a novel evidence collecting and recording system for a gun which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Evidence collecting and recording apparatus for collecting and preserving evidence of an event relating to the use of a gun, said apparatus comprising, in combination:

(a) an electronic evidence collecting device, having a source of electrical power and configured to be disposed on the gun, that comprises:

(1) an electronic imaging device; including an electronic camera; for producing first signals representing video images with a field of view in a direction of aim of the gun; and (2) a first transmitter ("T") device, coupled to said electronic imaging device, for transmitting said first signals representing said video images via a wireless short-range protocol;

(b) an electronic relay device; having a source of electrical power and adapted for use by a person authorized to carry the gun, that comprises:

(1) a first receiver ("R") device for receiving said first signals representing said video images transmitted from said first T device;

(2) a second transmitter ("T") device for transmitting second signals representing said video images via a wireless signal transmission network;

(3) a first data storage device; and (4) a first digital logic device, coupled to said first R device, to said second T device and to said first data storage device, for receiving and processing said first signals representing said video images and producing said second signals representing said video images for transmission via said transmission network; and (c) a remote central station, having a source of electrical power and having an evidence processing and collecting apparatus, that comprises:

(1) a second receiver ("R") device for receiving said second signals representing said video images transmitted from said second T device;

(2) a display device for displaying information;

(3) a second data storage device; and (4) a second digital logic device, coupled to said second R device, to said display device and to said second data storage device, for causing said display device to display said video images;

wherein at least one of said first digital logic device and said second digital logic device includes an algorithm for processing said signals representing said video images to determine an identity of a person appearing in said video images based on prior known information about said person that was previously stored in one of said first data storage device or said second data storage device, respectively.

2. The evidence collecting and recording apparatus defined in claim 1, wherein said electronic relay device is a smartphone.

3. The evidence collecting and recording apparatus defined in claim 1, wherein said second digital logic device causes the display device to display an identity of said person appearing in said video images.

4. The evidence collecting and recording apparatus defined in claim 1, wherein said second digital logic device produces third signals representing the identity of said person appearing in said video images, and wherein said central station further includes a third transmitter ("T") device for transmitting said third signals to said electronic relay device via said wireless network.

5. The evidence collecting and recording apparatus defined in claim 1, wherein at least one of said first digital logic device and said second digital logic device processes the video images to determine an identity of said person appearing in said video images based on facial recognition.

6. The evidence collecting and recording apparatus defined in claim 1, wherein the short-range wireless protocol is Bluetooth.

7. The evidence collecting and recording apparatus defined in claim 1, wherein the short-range wireless protocol is WiFi.

8. The evidence collecting and recording apparatus defined in claim 1, wherein the electronic evidence collecting device further includes a microphone and wherein said first signals and said second signals further represent a sound sensed by said microphone for transmission to said electronic relay device and to said remote central station, respectively.

9. The evidence collecting and recording apparatus defined in claim 1, further comprising a gun holster for holding said gun; wherein said electronic evidence collecting device includes a sensor device for determining when said gun is removed from said holster, and wherein said electronic evidence collecting device is operative, in response to said sensor device, to activate the electronic imaging device and to cause said first T device to transmit said first signals representing said video images to said first R device when said sensor device determines that the gun has been removed from the holster.

10. The evidence collecting and recording apparatus defined in claim 1, wherein said first digital logic device is operative to cause said first data storage device to store the video images received from the electronic evidence collecting device.

11. The evidence collecting and recording apparatus defined in claim 1, wherein the electronic evidence collecting device includes a third data storage device, coupled to the electronic imaging device, for storing the video images.

12. The evidence collecting and recording apparatus defined in claim 1, wherein said second digital logic device is connected to the Internet for receiving additional information about the person appearing in said video images.

* * * * *